US006084391A

United States Patent [19]

Onodera

[11] Patent Number: 6,084,391

[45] Date of Patent: Jul. 4, 2000

[54] BANDGAP REFERENCE VOLTAGE GENERATING CIRCUIT

[75] Inventor: Tadashi Onodera, Tokyo, Japan

[73] Assignee: NEC Corporation, Tokyo, Japan

[21] Appl. No.: 09/325,733

[22] Filed: Jun. 4, 1999

[30] Foreign Application Priority Data

Jun. 5, 1998 [JP] Japan ..... 10-157770

[51] Int. Cl.[7] ..... G05F 3/16

[52] U.S. Cl. ..... 323/315; 323/313

[58] Field of Search ..... 323/313, 314, 323/315; 327/535, 537, 538, 539, 541; 330/257, 288

[56] References Cited

U.S. PATENT DOCUMENTS

| | | | |
|---|---|---|---|
| 4,342,926 | 8/1982 | Whatley | 323/315 |
| 4,714,901 | 12/1987 | Jain et al. | 331/176 |
| 5,223,743 | 6/1993 | Nakagawara | 323/315 |
| 5,856,749 | 1/1999 | Wu | 327/66 |

FOREIGN PATENT DOCUMENTS

| | | |
|---|---|---|
| 5-204479 | 8/1993 | Japan . |
| 5-204480 | 8/1993 | Japan . |
| 6-309051 | 11/1994 | Japan . |

*Primary Examiner*—Matthew Nguyen
*Attorney, Agent, or Firm*—McGinn & Gibb, P.C.

[57] ABSTRACT

In a bandgap reference voltage generating circuit having first, second and third unitary circuits connected in parallel between a power supply voltage and a ground, there is added a fourth unitary circuit including an n-channel FET turned on in response to a bias voltage applied to a gate of the n-channel FET. The second unitary circuit is connected to the fourth unitary circuit through a capacitor having one end connected to a drain of the n-channel FET. When the bias voltage is applied to turn on the n-channel FET of the fourth unitary circuit, since the potential of the one end of the capacitor is dropped, a gate potential of n-channel FETs included in the first and second unitary circuits and operating in a weak inversion condition quickly becomes definite, so that a reference voltage can be generated quickly.

17 Claims, 4 Drawing Sheets

BANDGAP REFERENCE VOLTAGE GENERATING CIRCUIT

BACKGROUND OF THE INVENTION

1. Field of the Invention

The present invention relates to a bandgap reference voltage generating circuit, and more specifically to a bandgap reference voltage generating circuit having an elevated response speed.

2. Description of Related Art

In the prior art, since a voltage for driving an integrated circuit and others is required to be a stabilized reference voltage, a bandgap reference voltage generating circuit is used. Referring to FIG. 1, there is shown a circuit diagram of one example of the prior art bandgap reference voltage generating circuit.

The prior art bandgap reference voltage generating circuit shown in FIG. 1 includes first, second and third unitary circuits 1A, 2A and 3A, and is supplied with a power supply voltage Vdd to generate a reference voltage Vo determined by a band structure of a semiconductor by causing n-channel field effect transistors (FET) N1 and N2 of the first and second unitary circuits 1A and 2A to operate in a weak inversion condition.

Namely, assuming that a junction area ratio between diodes D1 and D2 is 1: N, and a resistance ratio between resistors R and xR is 1: x, the circuit output voltage Vo in a stabilized condition becomes $Vf+(\times kT/q)\bullet 1nN$, where $Vf=(kT/q)\bullet \ln(n_d/n_i)$, k is Boltzmann constant. T is absolute temperature, q is elementary charge, $n_i$ is intrinsic carrier density of the n-type semiconductor, and $n_d$ is donor density.

However, the above mentioned prior art bandgap reference voltage generating circuit has a problem that when a power supply is powered on, a gate potential of the FETs does not become definite, with the result that the stabilized reference voltage Vo cannot be quickly obtained.

SUMMARY OF THE INVENTION

Accordingly, it is an object of the present invention to provide a high speed bandgap reference voltage generating circuit capable of generating the stabilized reference voltage quickly after a power supply is powered on.

The above and other objects of the present invention are achieved in accordance with the present invention by a bandgap reference voltage generating circuit comprising a first unitary circuit having a first transistor of a first conductivity type and a switching second transistor of a second conductivity type opposite to the first conductivity type, which are connected in the named order in series between a first power supply voltage and a second power supply voltage, a second unitary circuit having a first resistor, a third transistor of the first conductivity type, and a switching fourth transistor of the second conductivity type which are connected in series in the named order between the first power supply voltage and the second power supply voltage, a third unitary circuit having a second resistor and a switching fifth transistor of the second conductivity type which are connected in series in the named order between the first power supply voltage and the second power supply voltage, and a fourth unitary circuit having a switching sixth transistor of the first conductivity type and a load seventh transistor of the second conductivity type which are connected in series in the named order between the first power supply voltage and the second power supply voltage, the sixth transistor being turned on in response to a bias voltage applied to a control electrode of the sixth transistor, a control electrode of the second transistor, a control electrode of the fourth transistor, a control electrode of the fifth transistor, and an output end of a main current path of the fourth transistor being connected one another, a control electrode of the first transistor, a control electrode of the third transistor and an input end of a main current path of the first transistor being connected one another to form a current mirror circuit, an input end of a main current path of the third transistor being connected to an input end of a main current path of the sixth transistor through a capacitor, so that when the sixth transistor is turned on in response to the bias voltage applied to the control electrode of the sixth transistor, a potential on one end of the capacitor connected to the input end of the main current path of the sixth transistor is dropped down, with the result that the second transistor and the fourth transistor are turned on so that the potential on the control electrode of the first and third transistors is quickly fixed, and a stabilized reference voltage is generated at a connection node between the second resistor and the fifth transistor.

With the above mentioned arrangement, the bias voltage can be supplied directly from a power supply voltage, or alternatively, from an output voltage of a bias voltage generating circuit driven by the power supply.

If the first to seventh transistors are formed of bipolar transistors, the main current path of the transistor is a collector-emitter path of the bipolar transistor, and a control electrode of the transistor is a base of the bipolar transistor. For example, the transistor of the first conductivity type is an NPN transistor, and the transistor of the second conductivity type is a PNP transistor. The output end of the main current path of the bipolar transistor is a collector in the case of the PNP transistor, and the input end of the main current path of the bipolar transistor is a collector in the case of the NPN transistor.

On the other hand, if the first to seventh transistors are formed of field effect transistors (FET), the main current path of the transistor is a drain-source path of the FET, and a control electrode of the transistor is a gate of the FET. In the latter case, for example, the first, third and sixth transistors are n-channel FETs and the second, fourth, fifth and seventh transistors are p-channel FETs. A gate of the n-channel FET of the sixth transistor is connected to receive the bias voltage. A drain of the n-channel FET of the first transistor is connected to a drain of the p-channel FET of the second transistor, and a drain of the n-channel FET of the third transistor is connected to a drain of the p-channel FET of the fourth transistor. A drain of the p-channel FET of the fifth transistor is connected to the second resistor, and a drain of the n-channel FET of the sixth transistor is connected to a gate and a drain of the p-channel FET of the seventh transistor. A gate of the p-channel FET of the second transistor, a gate and the drain of the p-channel FET of the fourth transistor, and a gate of the p-channel FET of the fifth transistor are connected one another. A gate and the drain of the n-channel FET of the first transistor and a gate of the n-channel FET of the third transistor are connected one another to form a current mirror circuit. The drain of the n-channel FET of the third transistor is connected to the drain of the n-channel FET of the sixth transistor through the capacitor. Thus, when the n-channel FET of the sixth transistor is turned on in response to the bias voltage, a potential on the end of the capacitor connected to the drain of the n-channel FET of the sixth transistor is dropped down, with the result that the p-channel FET of the second transistor and the p-channel FET of the fourth transistor are turned on so that the potential on the gate of the n-channel FETs of the first and third transistors is quickly fixed, and the n-channel FETs of the first and third transistors quickly operate in a weak inversion condition.

The above and other objects, features and advantages of the present invention will be apparent from the following description of preferred embodiments of the invention with reference to the accompanying drawings.

DESCRIPTION OF THE PREFERRED EMBODIMENTS

Figure 2:
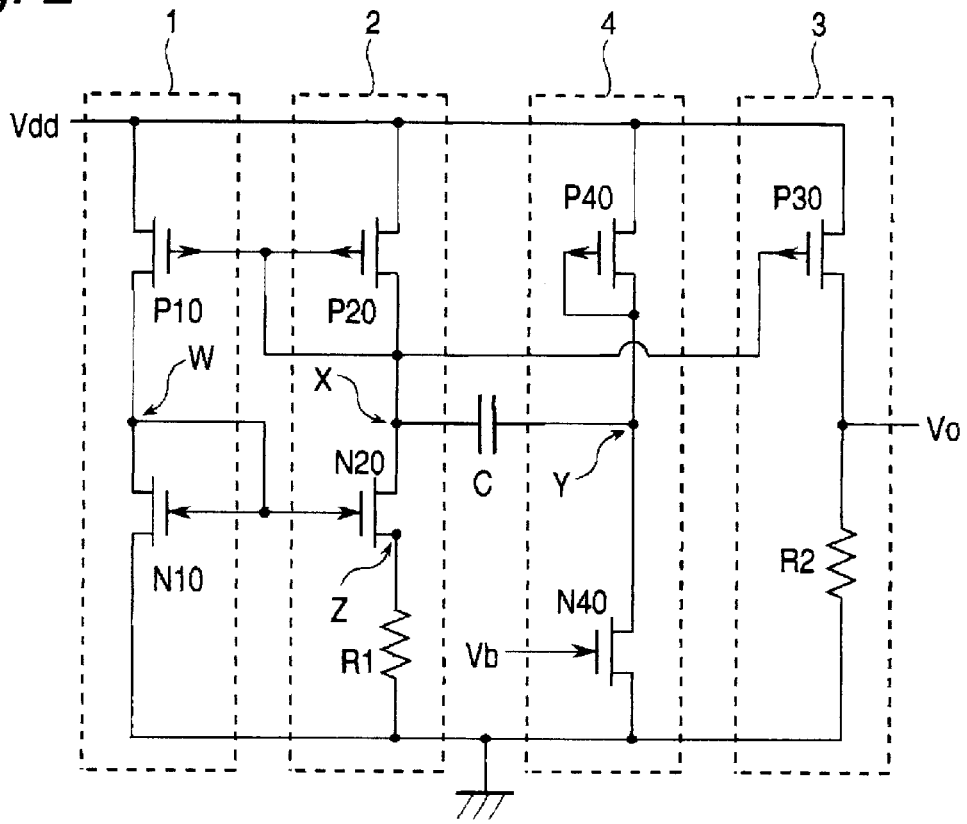
FIG. 2 is a circuit diagram of a first embodiment of the bandgap reference voltage generating circuit in accordance with the present invention.

Referring to FIG. 2, there is shown a circuit diagram of a first embodiment of the bandgap reference voltage generating circuit in accordance with the present invention.

Figure 1:
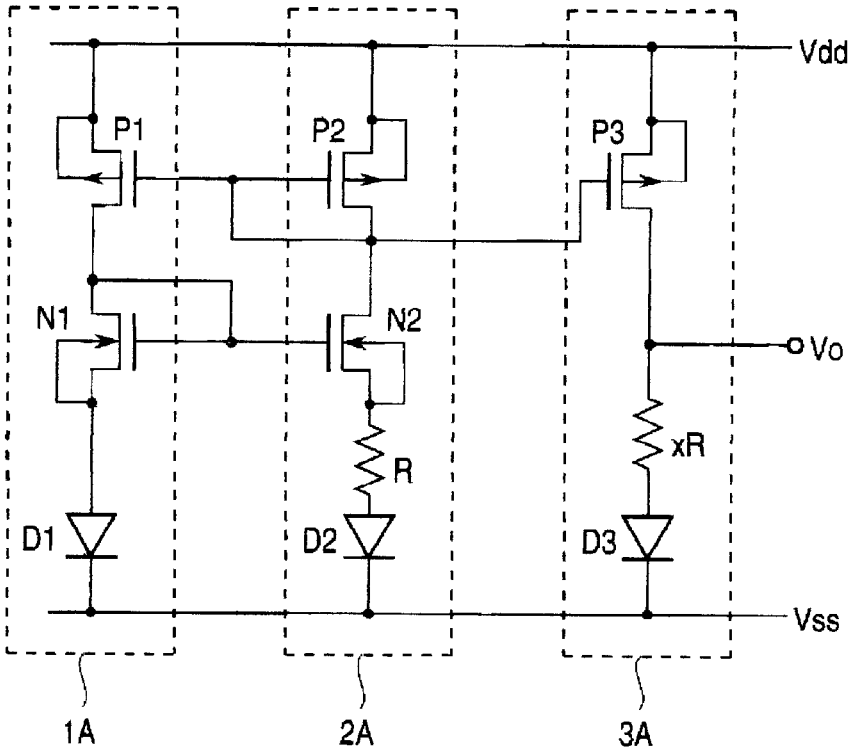
Fig. 1 PRIOR ART
FIG. 1 is a circuit diagram of one example of the prior art bandgap reference voltage generating circuit.

As seen from comparison between FIG. 1 and FIG. 2, the shown embodiment of the bandgap reference voltage generating circuit in accordance with the present invention is characterized in that a fourth unitary circuit 4 including an n-channel FET (N40) turned on in response to a bias voltage Vb, is added to a bandgap reference voltage generating circuit having first, second and third unitary circuits 1, 2 and 3 connected in parallel between a power supply voltage Vdd and a ground. The first, second and third unitary circuits 1, 2 and 3 are connected to one another, similarly to the prior art bandgap reference voltage generating circuit.

In brief, the first unitary circuit 1 includes an n-channel FET N10 having a source connected to the ground and a p-channel FET P10 having a source connected to the power supply voltage Vdd and a drain connected to a gate and a drain of the n-channel FET N10. The second unitary circuit 2 includes a resistor R1 having one end connected to the ground, an n-channel FET N20 having a source connected to the other end of the resistor R1, and a p-channel FET P20 having a source connected to the power supply voltage Vdd and a drain connected to a gate of the p-channel FET P20 itself and a drain of the n-channel FET N20. The third unitary circuit 3 includes a resistor R2 having one end connected to the ground, and a p-channel FET P30 having a source connected to the power supply voltage Vdd and a drain connected to the other end of the resistor R2. The reference voltage Vo is outputted from a connection node between the p-channel FET P30 and the resistor R2. The fourth unitary circuit 4 includes an n-channel FET N40 having a source connected to the ground and a p-channel FET P40 having a source connected to the power supply voltage Vdd and a drain connected to a gate of the p-channel FET P40 itself and a drain of the n-channel FET N40.

The first unitary circuit 1 and the second unitary circuit 2 are connected to each other in such a manner that the gate of the p-channel FET P10 is connected to the gate of the p-channel FET P20 and the gate of the n-channel FET N10 is connected to the gate of the n-channel FET N20.

The second unitary circuit 2 and the third unitary circuit 3 are connected to each other in such a manner that the gate of the p-channel FET P20 is connected to the gate of the p-channel FET P30.

The second unitary circuit 2 and the fourth unitary circuit 4 are connected to each other in such a manner that the drain of the n-channel FET N20 is connected to the drain of the n-channel FET N40 through a capacitor C.

In the above mentioned circuit connection, the p-channel FETs P10, P20 and P30 constitute a current mirror circuit in which the p-channel FET P20 functions as an input current path and each of the p-channel FETs P10 and P30 functions as an output current path. The n-channel FFTs N10 and N20 also constitute a current mirror circuit in which the n-channel FET N10 functions as an input current path and the n-channel FET N20 functions as an output current path.

Now, an operation of the bandgap reference voltage generating circuit shown in FIG. 2 will he described with reference to FIG. 3 which is a timing chart illustrating an operation of the bandgap reference voltage generating circuit in accordance with the present invention.

If the bias voltage Vh is applied to the gate of the n-channel FET N40 of the fourth unitary Circuit 4 from a bias voltage generating circuit (not shown in FIG. 2), a drain-source path of the n-channel FET N40 is turned on, so that a potential Vy on a node Y drops from the power supply voltage Vdd to a drain voltage of the turned-on n-channel FET N40.

With this drop of the potential Vy, a potential Vx on a node X drops from the power supply voltage Vdd to a divided voltage which is determined by a floating capacitance of the p-channel FET P20 and the capacitance of the capacitor C.

Since this potential Vx is applied to the gate of the p-channel FET P10 in the first unitary circuit 1 and the gate of the p-channel FET P20 in the second unitary circuit 2, the p-channel FET P10 and the p-channel FET P20 are turned on. Therefore, a potential Vw on a node W, which is a drain voltage of the turned-on p-channel FET P10, is applied to the gate of the n-channel FET N10 in the first unitary circuit 1 and the gate of the n-channel FET N20 in the second unitary circuit 2, so that both the n-channel FET N10 and the n-channel FET N20 start to operate in a weak inversion condition.

Figure 3:
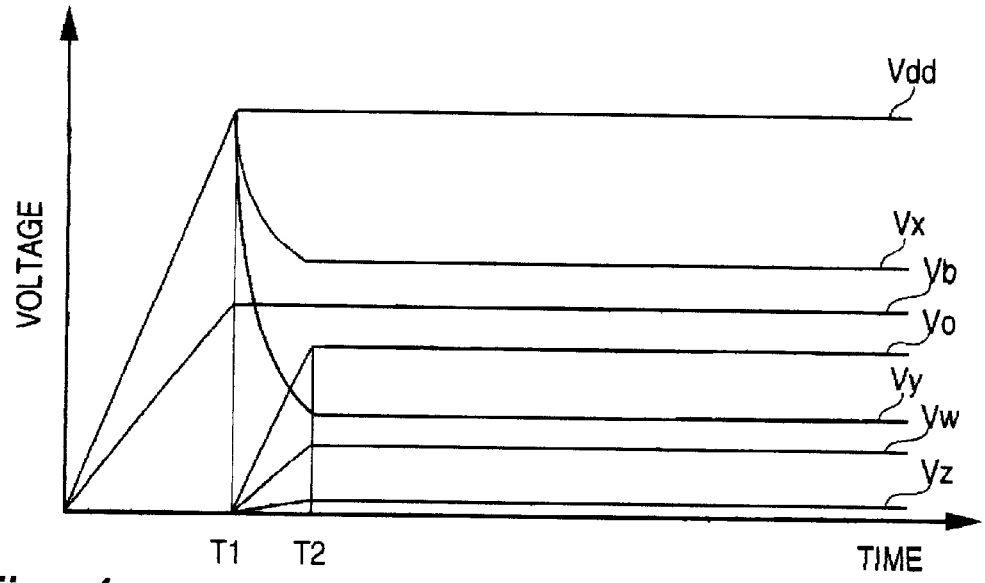
FIG. 3 is a timing chart illustrating an operation of the bandgap reference voltage generating circuit shown in FIG. 2.

Accordingly, as shown in FIG. 3, the drain voltage Vw of the n-channel FET N10 rises up, and succeedingly, a source voltage Vz of the n-channel FET N20 rises up, with the result that both the n-channel FET N10 and the n-channel FEPT N20 start to operate in the weak inversion condition.

On the other hand, since the p-channel FET P30 in the third unitary circuit 3 for outputting the reference voltage Vo receives at its gate the voltage Vx of the node X, the p-channel FET P30 has already started to operate before the n-channel FET N10 and the n-channel FET N20 start to operate. Accordingly, at a timing t2 where the n-channel FET N10 and the n-channel FET N20 operating in the weak inversion condition become a stabilized condition, the reference voltage Vo has reached a predetermined value.

In this embodiment, the reference voltage Vo of the predetermined value is generated at the timing t2 which is later than a timing t1 where the power supply voltage Vdd reaches a predetermined value. This time interval (t1 to t2) is a switching time of the two n-channel FETs N10 and N20 operating in the weak inversion condition. Thus, the shown embodiment of the bandgap reference voltage generating circuit in accordance with the present invention generates the reference voltage Vo of the predetermined value quickly after the power supply is powered on.

Figure 4:
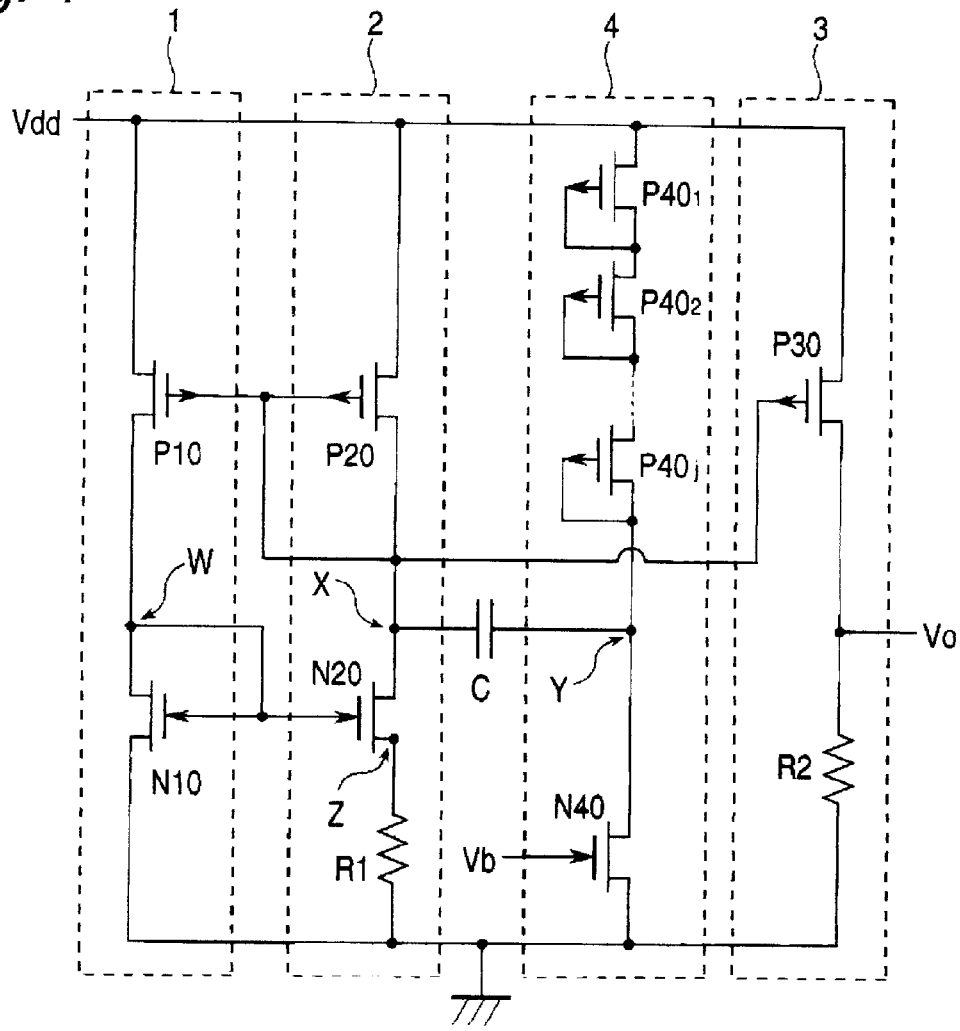
FIG. 4 is a circuit diagram of a second embodiment of the bandgap reference voltage generating circuit in accordance with the present invention.

Referring to FIG. 4, there is shown a circuit diagram of a second embodiment of the bandgap reference voltage generating circuit in accordance with the present invention.

As seen from comparison between FIG. 2 and FIG. 4, the second embodiment is different from the first embodiment only in that the p-channel FET P40 is replaced with a plurality of cascode-connected p-channel FETs, for example, "j" cascode-connected p-channel FETs $P40_1$, $P40_2$, •••$P40_j$ each of which has a gate and a drain connected to each other. Therefore, in FIG. 4, elements corresponding to those shown in FIG. 2 are given the same reference numbers, and explanation will be omitted.

Assuming that the operating characteristics of the p-channel FETs $P40_1$. $P40_2$,•••$P40_j$ are the same, and also expressing the threshold voltage in a drain current versus gate-source voltage characteristics by Vt, when the n-channel FET N40 and the p-channel FETs $P40_1$, $P40_2$, •••$P40_j$ are in the ON condition, the potential Vy on the node Y is expressed as $\{Vdd-j\times Vt\}$. In this embodiment, therefore, since the potential Vy can be further lowered in comparison with the first embodiment, the potential applied to the gate of the p-channel FETs P10, P20 and P30 is further lowered, with the result that the p-channel FETs P10, P20 and P30 are turned further quickly in comparison with the first embodiment.

Figure 5:
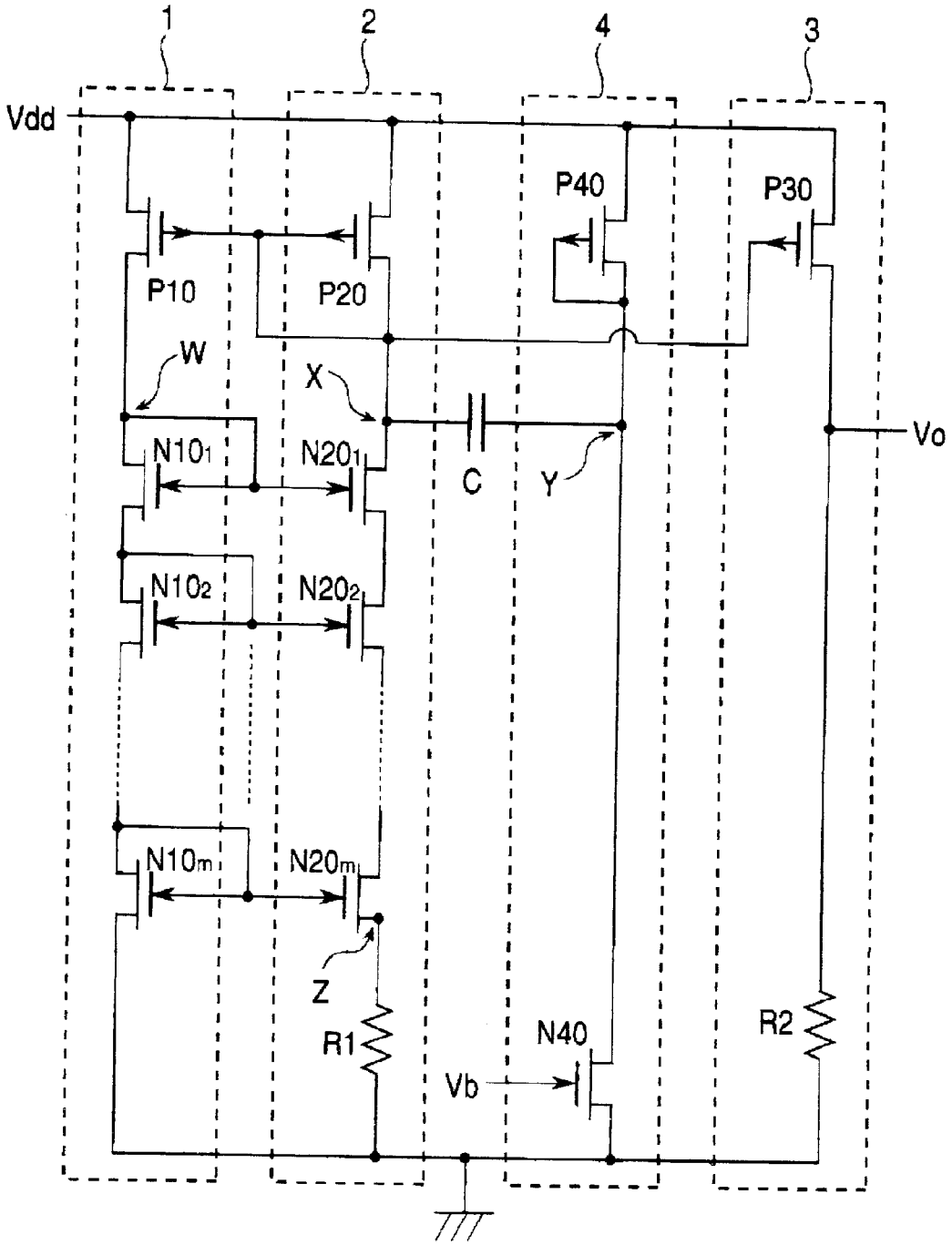
FIG. 5 is a circuit diagram of a third embodiment of the bandgap reference voltage generating circuit in accordance with the present invention.

Referring to FIG. 5, there is shown a circuit diagram of a third embodiment of the bandgap reference voltage generating circuit in accordance with the present invention.

As seen from comparison between FIG. 2 and FIG. 5, the third embodiment is different from the first embodiment only in that the two n-channel FETs N10 and N20 operating in the weak inversion condition are respectively replaced with a plurality of n-channel FETs $N10_1$, $N10_2$, •••N10m which are cascode-connected as shown in FIG. 5 and each of which has a gate and a drain connected to each other, and a plurality of n-channel FETs $N20_1$, $N20_2$, •••N20m which are cascode-connected as shown in FIG. 5. A gate of each of the n-channel FETs $N10_1$, $N10_2$, •••N10m is connected to a gate of a corresponding one of the n-channel FETs $N20_1$, $N20_2$, •••N20m. Therefore, in FIG. 5, elements corresponding to those shown in FIG. 2 are given the same reference numbers, and explanation will be omitted.

If the n-channel FETs are cascode-connected as shown in FIG. 5, a saturation characteristics in the drain voltage versus drain current characteristics of the whole of the cascode-connected n-channel FETs is improved in comparison with a single n-channel FET Therefore, the circuit operates with a reduced dependency upon the potential Vw of the node W, the potential Vx of the node X, and the potential Vy of the node Y.

Figure 6:
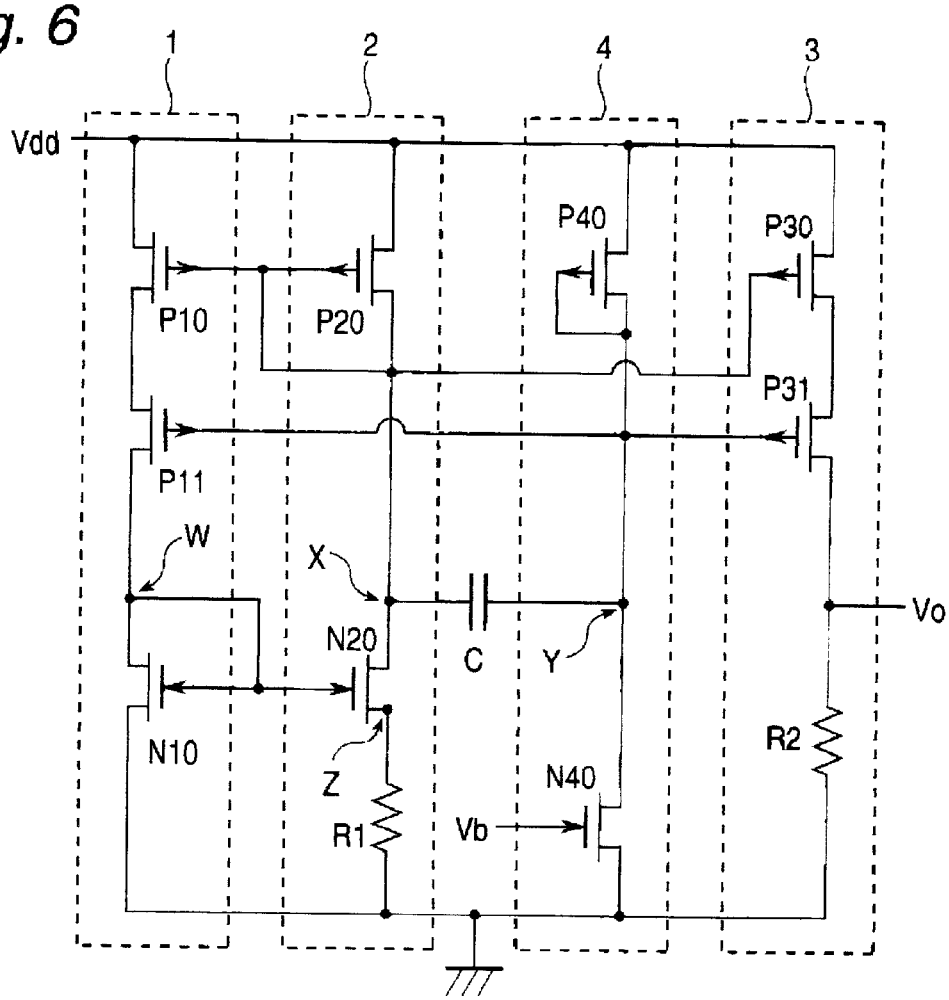
FIG. 6 is a circuit diagram of a fourth embodiment of the bandgap reference voltage generating circuit in accordance with the present invention.

Referring to FIG. 6, there is shown a circuit diagram of a fourth embodiment of the bandgap reference voltage generating circuit in accordance with the present invention.

As seen from comparison between FIG. 2 and FIG. 6, the fourth embodiment is different from the first embodiment only in that a p-channel FET P11 is inserted between the drain of the p-channel FET P10 and the drain of the n-channel FET N10 and a p-channel FET P31 is inserted between the drain of the p-channel FET P30 and the resistor R2, a gate of each of the p-channel FETs P11 and P31 being connected to the node Y. Therefore, in FIG. 6, elements corresponding to those shown in FIG. 2 are given the same reference numbers, and explanation will be omitted.

Since the gate of each of the p-channel FETs P11 and P31 is connected to the node Y, a gate potential of the p-channel FETs P11 and P31 are fixed at the same time as the n-channel FET N40 of the fourth unitary circuit 4 is brought into the ON condition in response to the bias voltage Vb.

On the other hand, since the potential Vx of the node X becomes definite at the same time as the potential Vy of the node Y becomes definite, the gate potential of the p-channel FETs P10, P11, P30 and P31 simultaneously become definite, and therefore, the p-channel FETs P10, P11, P30 and P31 are simultaneously turned on.

In addition, since the p-channel FETs P10 are P11 are cascode-connected and the p-channel FETs P30 are P31 are cascode-connected, saturation characteristics in the drain voltage versus drain current characteristics of the whole of the cascode-connected p-channel FETs is improved in comparison with a single p-channel FET. Therefore, the circuit operates with a reduced dependency upon the potential Vw of the node W, the potential Vx of the node X, and the potential Vy of the node Y. From this viewpoint, the cascode-connected p-channel FETs are in no way limited to the two cascode-connected p-channel FETs P10 are P11 or P30 are P3 1, but can be composed of more than two cascode-connected p-channel FETs.

In the above mentioned embodiments of the bandgap reference voltage generating circuit, it is necessary to supply the bias voltage Vb. However, this bias voltage Vb can be the power supply voltage Vdd.

If the bias voltage Vb is determined in accordance with the potential Vy of the node Y, it is possible to further quickly switch or turn on the n-channel FET N40. For this purpose, a bias voltage generating circuit may be provided.

Figure 7:
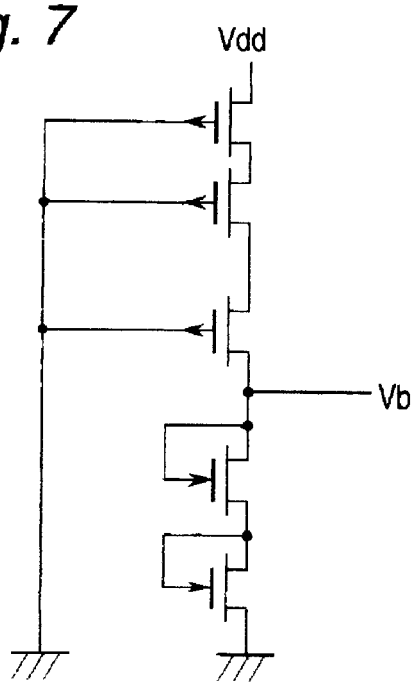
FIG. 7 is a circuit diagram of an example of the bias voltage generating circuit for supplying the bias voltage to the bandgap reference voltage generating circuit in accordance with the present invention.

Referring to FIG. 7, there is shown a circuit diagram of an example of the bias voltage generating circuit for supplying the bias voltage to the bandgap reference voltage generating circuit in accordance with the present invention.

The shown bias voltage generating circuit includes a plurality of cascode-connected, gate-grounded p-channel FETs and a plurality of cascode-connected n-channel FETs, which are connected in series between the power supply voltage Vdd and the ground. Each of the n-channel FETs has a gate connected to a drain of the n-channel FET itself. The bias voltage Vb is outputted from a connection node between a drain of the p-channel FET and a drain of the n-channel FET.

Figure 8:
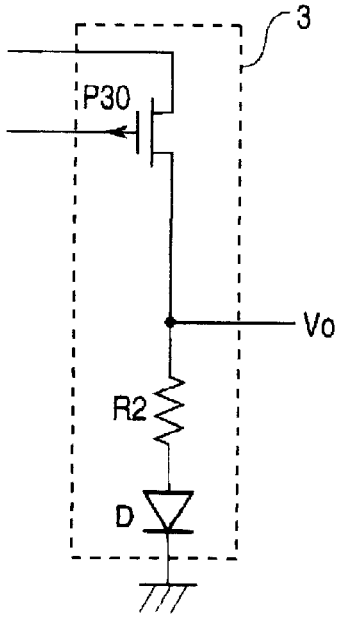
FIG. 8 is a circuit diagram of the third unitary circuit for illustrating a modification of the bandgap reference voltage generating circuit in accordance with the present invention.

In the above mentioned embodiments of the bandgap reference voltage generating circuit, the resistor R2 in the third unitary circuit 3 is connected directly to the ground. However, as shown in FIG. 8, a diode D can be inserted in a forward-direction between the resistor R2 and the ground in such a manner that an anode of the diode D is connected to the one end of resistor R2 and a cathode of the diode D is connected to the ground. In this case, the reference voltage Vo is elevated up by a forward-direction voltage drop of the diode D. In addition, by inserting the diode D, the temperature dependency of the reference voltage Vo can be reduced.

In the above mentioned embodiments of the bandgap reference voltage generating circuit, the resistors R1 and R2 are provided to limit the currents flowing in the second and third unitary circuits 2 and 3, respectively. Therefore, the resistors R1 and R2 can be omitted dependently upon the power supply voltage Vdd and the characteristics of each FET.

In the above mentioned embodiments of the bandgap reference voltage generating circuit, one of a pair of power supply voltages is the ground. However, the ground terminal can be replaced with a terminal of the power supply for supplying a negative voltage Vss.

The above mentioned embodiments of the bandgap reference voltage generating circuit are constituted of FETs, however, it would be apparent to persons skilled in the art that the bandgap reference voltage generating circuit in accordance with the present invention can be constituted of bipolar transistors. In this case, it can be considered that a PNP transistor corresponds to the p-channel FET and an NPN transistor corresponds to the n-channel PET, and a collector, a base and an emitter of the bipolar transistor correspond to the drain, the gate and the source of the FET.

As mentioned above, the bandgap reference voltage generating circuit in accordance with the present invention is characterized in that a fourth unitary circuit including a transistor turned on in response to a bias voltage is added to a prior art bandgap reference voltage generating circuit having first, second and third unitary circuits connected in parallel between a first power supply voltage and a second power supply voltage, and the second unitary circuit is connected to the fourth unitary circuit through the capacitor. Therefore, since the second unitary circuit is caused to quickly operate by the fourth unitary circuit, the reference voltage can be generated quickly.

In some embodiments, since a plurality of n-channel FETs operating in the weak inversion condition are cascode-connected, and/or a plurality of switching p-channel FETs are cascode-connected, the saturation characteristics is improved, so that the circuit operates with a reduced dependency upon the voltage on various nodes in the circuit. Thus, the reference voltage can be generated further quickly.

The invention has thus been shown and described with reference to the specific embodiments. However, it should be noted that the present invention is in no way limited to the details of the illustrated structures but changes and modifications may be made within the scope of the appended claims.

I claim:

1. A bandgap reference voltage generating circuit comprising a first unitary circuit having a first transistor of a first conductivity type and a switching second transistor of a second conductivity type opposite to said first conductivity type, which are connected in the named order in series between a first power supply voltage and a second power supply voltage, a second unitary circuit having a first resistor, a third transistor of said first conductivity type, and a switching fourth transistor of said second conductivity type which are connected in series in the named order between said first power supply voltage and said second power supply voltage, a third unitary circuit having a second resistor and a switching fifth transistor of said second conductivity type which are connected in series in the named order between said first power supply voltage and said second power supply voltage, and a fourth unitary circuit having a switching sixth transistor of said first conductivity type and a load seventh transistor of said second conductivity type which are connected in series in the named order between said first power supply voltage and said second power supply voltage, said sixth transistor being turned on in response to a bias voltage applied to a control electrode of said sixth transistor, a control electrode of said second transistor, a control electrode of said fourth transistor, a control electrode of said fifth transistor, and an output end of a main current path of said fourth transistor being connected one another, a control electrode of said first transistor, a control electrode of said third transistor and an input end of a main current path of said first transistor being connected one another to form a current mirror circuit, an input end of a main current path of said third transistor being connected to an input end of a main current path of said sixth transistor through a capacitor, so that when said sixth transistor is turned on in response to said bias voltage applied to said control electrode of said sixth transistor, a potential on one end of said capacitor connected to the input end of the main current path of said sixth transistor is dropped down, with the result that said second transistor and said fourth transistor are turned on so that the potential on the control electrode of said first and third transistors is quickly fixed, and a stabilized reference voltage is generated at a connection node between said second resistor and said fifth transistor.

2. A bandgap reference voltage generating circuit claimed in claim 1 wherein said first, third and sixth transistors are n-channel FETs and said second, fourth, fifth and seventh transistors are p-channel FETs, and a gate of the n-channel FET of said sixth transistor is connected to receive said bias voltage, a drain of the n-channel FET of said first transistor being connected to a drain of the p-channel FET of said second transistor, a drain of the n-channel FET of said third transistor being connected to a drain of the p-channel FET of said fourth transistor, a drain of the p-channel FET of said fifth transistor being connected to said second resistor, a drain of the n-channel FET of said sixth transistor being connected to a gate and a drain of the p-channel FET of said seventh transistor, a gate of the p-channel FET of said second transistor, a gate and said drain of the p-channel FET of said fourth transistor, and a gate of the p-channel FET of said fifth transistor being connected one another, a gate and said drain of the n-channel FET of said first transistor and a gate of the n-channel FET of said third transistor being connected one another to form a current mirror circuit, the drain of the n-channel FET of said third transistor being connected to said drain of the n-channel FET of said sixth transistor through said capacitor, so that when the n-channel FET of said sixth transistor is turned on in response to said bias voltage, the potential on the end of said capacitor connected to the drain of the n-channel FET of said sixth transistor is dropped down, with the result that the p-channel FET of said second transistor and the p-channel FET of said fourth transistor are turned on so that the potential on the gate of the n-channel FETs of said first and third transistors is quickly fixed, and the n-channel FETs of said first and third transistors quickly operate in a weak inversion condition.

3. A bandgap reference voltage generating circuit claimed in claim 2 wherein said bias voltage is said second power supply voltage.

4. A bandgap reference voltage generating circuit claimed in claim 2 wherein said bias voltage is supplied from a bias voltage generating circuit including a plurality of cascode-connected p-channel FETs and a plurality of cascode-connected n-channel FETs, which are connected in series between said second power supply voltage and said first power supply voltage so that said bias voltage Vb is outputted from a connection node between a drain of the p-channel FET and a drain of the n-channel FET.

5. A bandgap reference voltage generating circuit claimed in claim 2 wherein said third unitary circuit includes at least one forward-directed diode inserted between said second resistor and said power supply voltage.

6. A bandgap reference voltage generating circuit claimed in claim 2 wherein said fifth transistor is constituted of a plurality of cascode-connected p-channel FFTs each of which has a gate and a drain connected to each other.

7. A bandgap reference voltage generating circuit claimed in claim 6 wherein said bias voltage is said second power supply voltage.

8. A bandgap reference voltage generating circuit claimed in claim 6 wherein said bias voltage is supplied from a bias voltage generating circuit including a plurality of cascode-connected p-channel FETs and a plurality of cascode-connected n-channel FETs, which are connected in series between said second power supply voltage and said first power supply voltage so that said bias voltage Vb is outputted from a connection node between a drain of the p-channel FET and a drain of the n-channel FET.

9. A bandgap reference voltage generating circuit claimed in claim 6 wherein said third unitary circuit includes at least one forward-directed diode inserted between said second resistor and said power supply voltage.

10. A bandgap reference voltage generating circuit claimed in claim 2 wherein said first transistor is constituted of a plurality of n-channel FETs which are cascode-connected and each of which has a gate and a drain connected to each other, and said third transistor is constituted of a plurality of n-channel FETs which are cascode-connected, a gate of each of said n-channel FETs constituting said first transistor being connected to a gate of a corresponding n-channel FET of said n-channel FETs constituting said third transistor.

11. A bandgap reference voltage generating circuit claimed in claim 10 wherein said bias voltage is said second power supply voltage.

12. A bandgap reference voltage generating circuit claimed in claim 10 wherein said bias voltage is supplied from a bias voltage generating circuit including a plurality of cascode-connected p-channel FETs and a plurality of cascode-connected n-channel FETs, which are connected in series between said second power supply voltage and said first power supply voltage so that said bias voltage Vb is outputted from a connection node between a drain of the p-channel FET and a drain of the n-channel FET.

13. A bandgap reference voltage generating circuit claimed in claim 10 wherein said third unitary circuit includes at least one forward-directed diode inserted between said second resistor and said power supply voltage.

14. A bandgap reference voltage generating circuit claimed in claim 2 wherein said first unitary circuit includes at least one additional p-channel FET inserted between the drain of the p-channel FET of said second transistor and the drain of the n-channel FET of said first transistor, said third unitary circuit includes at least one additional p-channel FET inserted between the drain of the p-channel FET of said first transistor and said second resistor, a gate of said at least one additional p-channel FET of said first unitary circuit and a gate of said at least one additional p-channel FET of said third unitary circuit being connected to the drain of the n-channel transistor of said sixth transistor.

15. A bandgap reference voltage generating circuit claimed in claim 14 wherein said bias voltage is said second power supply voltage.

16. A bandgap reference voltage generating circuit claimed in claim 14 wherein said bias voltage is supplied from a bias voltage generating circuit including a plurality of cascode-connected p-channel FETs and a plurality of cascode-connected n-channel FETs, which are connected in series between said second power supply voltage and said first power supply voltage so that said bias voltage Vb is outputted from a connection node between a drain of the p-channel FET and a drain of the n-channel FET.

17. A bandgap reference voltage generating circuit claimed in claim 14 wherein said third unitary circuit includes at least one forward-directed diode inserted between said second resistor and said power supply voltage.

* * * * *